United States Patent [19]

Moore et al.

[11] 4,405,465

[45] Sep. 20, 1983

[54] PROCESS FOR THE REMOVAL OF CHLORATE AND HYPOCHLORITE FROM SPENT ALKALI METAL CHLORIDE BRINES

[75] Inventors: Sanders H. Moore; Ronald L. Dotson, both of Cleveland, Tenn.

[73] Assignee: Olin Corporation, New Haven, Conn.

[21] Appl. No.: 393,578

[22] Filed: Jun. 30, 1982

[51] Int. Cl.[3] ..... C25B 1/34

[52] U.S. Cl. ..... 210/757; 210/750; 210/765; 204/98; 204/128

[58] Field of Search ..... 204/98, 128; 423/437, 423/478; 210/765, 805, 683, 698, 757, 750

[56] References Cited

U.S. PATENT DOCUMENTS

| | | | |
|---|---|---|---|
| 3,891,747 | 6/1975 | Galecki et al. | 423/499 |
| 4,272,338 | 6/1981 | Lynch et al. | 204/98 |
| 4,303,624 | 12/1981 | Dotson et al. | 423/184 |

FOREIGN PATENT DOCUMENTS 506394 5/1939 United Kingdom .

*Primary Examiner*—Richard Andrews

*Attorney, Agent, or Firm*—James B. Haglind; Donald F. Clements

[57] ABSTRACT

A process is described for reducing the concentration of oxyhalogen impurities in an alkali metal halide brine recovered from an electrolytic cell which comprises circulating the alkali metal halide brine to a treatment zone outside of the electrolytic cell. Within the treatment zone, the alkali metal halide brine is reacted with oxalic acid while maintaining the alkali metal halide brine at a pH of less than about 4.5. A purified brine having a substantially reduced concentration of oxyhalogen impurities is recovered from the treatment zone. The process may be employed in treating brines recovered from mercury cells and membrane cells for the production of chlorine and alkali metal hydroxides and its employment results in a substantial reduction in the amount of concentrated acid required in brine treatment and a reduction in energy costs for brine purification.

10 Claims, No Drawings

PROCESS FOR THE REMOVAL OF CHLORATE AND HYPOCHLORITE FROM SPENT ALKALI METAL CHLORIDE BRINES

This invention relates to improvements in the purification of aqueous solutions of alkali metal chlorides. More particularly, it concerns an improved method for removing chlorate impurities from aqueous solutions of alkali metal chlorides. The alkali metal chloride solutions thus treated may be employed in electrolytic cell processes for producing chlorine.

Aqueous solutions of alkali metal chlorides, for example, those obtained as effluents, for example, depleted brines, from electrolytic processes used in chlorine manufacture, contain varying amounts of hypochlorite and chlorate ions which are formed during the electrolysis of brine. Prior to reusing the alkali metal chloride solutions in the electrolytic process, it is frequently necessary to remove or reduce the hypochlorite and chlorate content to a level which will not cause a reduction in current efficiency; adversely effect the corrosion rate of anodes; or contaminate the alkali metal hydroxide product solutions recovered from the cell. This is particularly important in electrolytic cells where a large percentage of the alkali metal chloride brine is continuously recycled. Successful operation of electrolytic cells employing ion exchange membranes requires a high degree of brine purity.

Brine recovered from electrolytic cells which recirculate the brine have been treated for hypochlorite and chlorate reduction or elimination by the addition of a mineral acid such as hydrochloric acid or sulfurous acid as described in British Pat. No. 506,394 issued to I. G. Farbenindustries. The treated brine is then blown with air or $CO_2$ or placed under a vacuum to remove $Cl_2$ present. Where hydrochloric acid is employed, excessive amounts are required in particular to effectively reduce the chlorate ion concentration. The use of sulfurous acid or other sulfur-containing compounds such as alkali metal hydrosulfates (U.S. Pat. No. 3,891,747, issued June 24, 1975, to G. A. Galecki et al) introduces sulfur-oxygen groups which are oxidized to sulfate. Sulfate ions are undesirable in brines fed to membrane cells and their concentration is carefully controlled.

U.S. Pat. No. 4,272,338, issued June 9, 1981, to R. L. Dotson et al teaches the use of an inorganic peroxide such as $H_2O_2$ to remove dissolved chlorine and hypohalite ions such as hypochlorite or hypobromite ions. Inorganic peroxides are not particularly effective in eliminating or reducing the chlorate ions present. In addition, the process teaches the use of a reducing agent such as an alkali metal thiosulfate to ensure complete reaction of hypochlorite ions present.

U.S. Pat. No. 4,303,624, issued Dec. 1, 1981, to R. L. Dotson et al teaches the treatment of alkali metal chloride brines containing calcium ion impurities by the addition of an alkali metal carboxylate such as sodium oxalate. The calcium precipitate is a chelate structure having the formula:

$$Ca^{2}(+)[(-)OOC(CH_2)_nCOO(-)]$$

where n is 0 to 6.

In an article on "Chelating Agents" in the Kirk-Othmer *Encyclopedia of Chemical Technology* (vol. 5, pp. 339–368), the chelation of oxalates with calcium is discussed in the penultimate paragraph on page 355 and illustrated in FIG. 4 on page 356. As shown, at pH's below about 6, the oxalate liquid becomes progressively protonated, chelation with calcium does not take place, and the precipitate with calcium is not formed.

U.S. Pat. No. 4,303,624 further states that the addition of alkali metal carboxylates reduces the concentration of alkali metal chlorate in brine. Significant reductions of chlorate present in brine do not take place at pH's above about 4.5 as it requires strongly acidic solutions for the decomposition of the chlorate ions.

Now a process has been discovered which effectively reduces hypochlorite and chlorate ion concentrations in alkali metal chloride brines recovered from electrolytic cells while employing reduced amounts of mineral acids and eliminating the need for the addition of sulfur-containing reducing agents.

The novel process of the present invention for reducing the concentration of oxyhalogen impurities in an alkali metal halide brine recovered from an electrolytic cell comprises circulating the alkali metal halide brine to a treatment zone outside of the electrolytic cell and admixing oxalic acid with the alkali metal halide brine while maintaining the alkali metal halide brine at a pH of less than about 4.5. The process produces a purified brine having a substantially reduced concentration of the oxyhalogen impurities which is recovered as a purified brine from the treatment zone.

While the process of the present invention is suitable for use with alkali metal halide brines including sodium chloride, potassium chloride, lithium chloride, sodium bromide, potassium bromide, lithium bromide and mixtures thereof, in order to simplify the disclosure, the process of the invention will be described in terms of sodium chloride.

Sodium chloride brines recovered from electrolytic cells are commonly called "spent brines." Spent brines from cells such as those which employ ion exchange membranes for producing chlorine gas and a solution of sodium hydroxide, contain hypochlorite ions, chlorate ions and dissolved chlorine gas. The brines are at a temperature in the range of from about 70° to about 95° C. and have a pH in the range of from about 3.5 to about 5.5. Spent sodium chloride brine typically contains hypochlorite ion, $OCl^-$, at a concentration in the range of from about 0.25 to about 2.00 grams per liter; dissolved chlorine, $Cl_2$, at a concentration in the range of from about 0.25 to about 2.50 grams per liter; and chlorate ion, $ClO_3^-$, at a concentration of from about 1 to about 10 grams per liter.

Oxalic acid is admixed with a spent brine in amounts suitable for reducing the concentration of hypochlorite ions and chlorate ions to the desired levels.

In one embodiment, the total amount of spent brine is treated with oxalic acid in amounts suitable for substantially reducing the chlorate ion present as the chlorate ions are considerably more difficult to reduce than hypochlorite ions. Where this is the case, suitable amounts of the oxalic compound are in the range of from about 0.05 to about 5.0, and preferably from about 2.0 to about 4.0 moles of oxalic acid per mole of chlorate ion. Greater amounts of oxalic acid, however, may be used, if desired.

In an alternate embodiment, the total amount of spent brine is treated with sufficient amounts of oxalic acid to substantially reduce the hypochlorite ions present and a portion of the spent brine is further treated to significantly reduce the chlorate ion concentration. Thus the total amount of spent brine is admixed with from about 0.03 to about 2.0 moles of oxalic acid per mole of hypochlorite ion and a substantially hypochorite-free brine obtained. A portion of this hypochlorite-free brine, for example, up to about 50 percent, and preferably from about 10 to about 30 percent by volume, is treated with the amounts of oxalic acid specified above for substantially reducing chlorate ion concentration.

The oxalic acid treated brine is acidified to reduce the pH of the spent brine to less than about 4.5, preferably within the range of from about 0 to about 2, and more preferably within the range of 0 to about 1. The pKa's (negative logarithms of an acidic dissociation constants) for oxalic acid are 1.27 and 4.27 in water at 25° C. While acidification can be accomplished by any suitable acid, it is preferable to use hydrochloric acid or phosphoric acid as they do not introduce undesirable anions into the spent brine solution.

Within the treatment zone, the reaction between oxalic acid and the oxyhalogen impurities in the brine is carried out for a period of from about five minutes to about 150 minutes, preferably from about 20 to about 120 minutes, and more preferably from about 30 to about 90 minutes. Longer reaction times may be employed, however, if desired.

The novel process of the present invention is carried out at any suitable temperatures, for example, those in the range of from about 60° to about 110° C. It is preferably carried out at temperatures which do not require external heating of the spent brine, for example, those in the range of from about 60° to about 90° C. Where the total spent brine is treated to substantially reduce the hypochlorite ion concentration, temperatures at the lower end of the range may be used, the portion being subsequently treated to substantially reduce chlorate ions being at temperatures from about 75° to 100° C.

While not wishing to be bound by theory, it is believed that the oxalic acid reacts with the hypochlorite ion according to the following equation:

$$ClO^- + H_2C_2O_4 \rightarrow Cl^- + 2CO_2 + H_2O.$$

The chlorate ions present are believed to be reduced by oxalic acid in the following manner:

$$2HClO_3 + H_2C_2O_4 \rightarrow 2ClO_2 + 2CO_2 + 2H_2O.$$

Following the reduction of chlorate ions and hypochlorite ions by treatment with oxalic acid, the dissolved chlorine and that formed during the treatment as well as any chlorine dioxide formed is removed by known methods such as air stripping, dechlorinating by use of an applied vacuum, and the like.

The spent brine, having substantially reduced concentrations of chlorate ions and hypochlorite ions and free of dissolved chlorine, is resaturated by evaporating a portion of the water or by the addition of concentrated brine or solid salt to provide a NaCl concentration of at least 200 grams per liter up to saturation values at the temperatures employed.

Because of the presence of impurities in the concentrated brine or solid salt, the resaturated brine is normally treated with an alkali metal carbonate and/or an alkali metal hydroxide to reduce the concentration of alkaline earth metals such as calcium and magnesium. The alkaline brine thus treated is filtered to remove the insoluble calcium and magnesium compounds as well as other insoluble impurities.

Where the brine is to be electrolyzed in an electrolytic cell employing an ion exchange membrane, for example, a cation exchange membrane, it is frequently necessary to further reduce the concentration of calcium and magnesium ions. One commonly employed method is to pass the purified resaturated brine through an ion exchange process.

The novel process of the present invention for treating spent brines can be employed in any electrolytic cell in which brine is recirculated which contains chlorate ions and hypochlorite ions where these ions are undesirable. Suitable electrolytic cells include cells having a flowing mercury cathode, commonly called mercury cells and electrolytic membrane cells employing flexible membranes having ion exchange properties and which are substantially impervious to the hydrodynamic flow of the electrolyte and the passage of gas products produced in the cell. Suitably used are cation exchange membranes such as those comprised of fluorocarbon polymers having a plurality of pendant sulfonic acid groups or carboxylic acid groups or mixtures of sulfonic acid groups and carboxylic acid groups. The terms "sulfonic acid groups" and "carboxylic acid groups" are meant to include salts of sulfonic acid or salts of carboxylic acid which are suitably converted to or from the acid groups by processes such as hydrolysis.

Preferred as cation exchange membranes are those comprised of a blend of a fluorinated polymer which has sulfonyl functional groups and a polymer which has carboxylic acid functional groups. Membranes of this type are described in U.S. Pat. No. 4,176,215, issued Nov. 27, 1979, to C. J. Molnar et al. These membranes are made by blending a melt-fabricable form of a first fluorinated polymer which contains sulfonyl functional groups and a melt-fabricable form of a second fluorinated polymer which contains carboxylic functional groups.

Any suitable electrodes may be used as the anode or cathode in electrolytic membrane cells or mercury cells employing the novel process of the present invention. Typical anodes are those of graphite or a foraminous metal such as titanium or tantalum having an electroactive coating over at least a portion of the anode surface. Suitable coatings include those of a platinum group metal, platinum group metal oxide, an alloy of a platinum group metal or mixtures thereof. The term "platinum group metal" means an element of the group consisting of ruthenium, rhodium, platinum, palladium, osmium, and iridium.

Also effective are anodes composed of graphite, or anodes comprised of a metal oxide coated substrate such as described in U.S. Pat. No. 3,632,498, issued to H. B. Beer on Jan. 4, 1972. When such electrodes are employed as anodes, anodic chlorine overvoltage is minimized. Any electrode construction capable of effecting electrolytic production of alkali metal hydroxide such as sodium hydroxide, potassium hydroxide or mixtures thereof, from a brine containing alkali metal halides such as sodium chloride, potassium chloride, or mixtures thereof, may be employed in the process of this invention.

Examples of materials which may be employed as the cathode in electrolytic membrane cells are carbon steel, stainless steel, nickel, nickel molybdenum alloys, nickel vanadium alloys and others. Any cathode material that is capable of effecting the electrolytic reduction of water with either high or low hydrogen overvoltage may be used as cathode construction material in the process of this invention.

The cathode and anode may each be of either solid, felt, mesh, foraminous, packed bed, expanded metal or other design.

The novel process of the present invention effectively reduces hypochlorite ion and chlorate ion concentration in spent brines recovered from electrolytic cells employed in the production of halogens and alkali metal hydroxides. Addition of oxalic acid to the spent brine results in efficient brine purification while reducing the amount of concentrated acid required in the brine treatment.

The following examples are presented to define the invention more fully without any intention of being limited thereby. All parts and percentages are by weight unless otherwise indicated.

EXAMPLE 1

Sodium chloride brine (1100 mls) containing 248 gpl of NaCl and 7.4 gpl (0.07 moles) of $NaClO_3$ and at a temperature of 90° C. was added to a reaction vessel equipped with an agitator. The brine was acidifed with 20 mls hydrochloric acid (35% by weight of HCl) to a pH in the range of 0 to 0.5. Oxalic acid (18.9 gpl, 0.21 moles) was added to the brine. The reaction mixture was agitated and the sodium chlorate concentration measured periodically. Chlorate reduction results were as follows:

| Time (minutes) | $ClO_3^-$ (gpl) |
|---|---|
| 0 | 7.4 |
| 10 | 4.0 |
| 30 | 1.1 |
| 60 | 0.6 |
| 90 | 0.3 |
| 120 | 0.3 |
| 180 | 0.2 |

COMPARATIVE EXAMPLE A

Sodium chloride brine (1100 mls) containing 246.3 gpl of NaCl, 3.67 gpl of NaOCl and 5.09 gpl of $NaClO_3$ were removed from the anolyte compartment of an electrolytic membrane cell. The brine was treated by the addition of conc.hydrochloric acid (35% by weight of HCl) to reduce the concentrations of NaOCl and $NaClO_3$ ions. The results were as follows:

| 35% HCl Added (ml) | $ClO_3$ (gpl) | OCl (gpl) |
|---|---|---|
| 0 | 5.1 | 3.7 |
| 25 | 5.0 | 0.3 |
| 50 | 4.6 | ND* |
| 75 | 3.5 | ND |
| 100 | 2.0 | ND |
| 125 | 0.4 | ND |
| 140 | 0.2 | ND |

*ND = Not detectable

The novel process of the present invention as illustrated in Example 1 in which 20 mls of 35% HCl and oxalic acid at a mol ratio of 3:1 per mol of $ClO_3^-$, were added to NaCl brine achieves the same level of chlorate ion reduction as the process of comparative Example A which required the addition of 140 mls. of 35% HCl. Brine dilution and the cost of chlorate ion reduction are significantly reduced by the process of the present invention.

EXAMPLE 2

Sodium chloride brine (100 grams) containing 250 grams per liter (gpl) of NaCl, 1.59 gpl of $NaClO_3$ and 5.51 gpl of NaOCl and at a temperature of 90° C. was added to a reaction vessel equipped with an agitator. The brine pH was reduced within the range of from about 0 to about 0.5 by the addition of hydrochloric acid Following the lowering of the brine pH, the concentration of $NaClO_3$ was determined to be 1.35 gpl and that of the NaOCl was 1.07 gpl. One gram of oxalic acid was added to the brine and the solution agitated for 1 hour. At the end of the reaction period, the brine contained 0.59 gpl of $NaClO_3$ and 0.05 gpl of NaOCl. The treatment with oxalic acid at a mol ratio of 0.125 per mol of chlorate ion, resulted in a 56.2% reduction of the $NaClO_3$ concentration and a 95.3% reduction of the NaOCl concentration.

What is claimed is:

1. A process for reducing the concentration of oxyhalogen impurities in an alkali metal halide brine recovered from an electrolytic cell which comprises:

(a) circulating the alkali metal halide brine to a treatment zone outside of said electrolytic cell; and (b) acidifying said alkali metal halide brine to maintain a pH in the range of from about 0 to about 2;

(c) admixing oxalic acid with said alkali metal halide brine to produce a purified brine having a substantially reduced concentration of said oxyhalogen impurities; and (d) recovering said purified brine from said treatment zone.

2. The process of claim 1 in which said alkali metal halide brine is an alkali metal chloride brine selected from the group consisting of sodium chloride and potassium chloride, and said oxyhalogen impurities are hypochlorite ions and chlorate ions.

3. The process of claim 2 in which said brine is at a temperature in the range of from about 60° to about 110° C.

4. The process of claim 3 in which the mol ratio of oxalic acid to chlorate ion is from about 0.05:1 to about 5.0:1.

5. The process of claim 1 in which said purified brine is resaturated by admixing with a concentrated brine or solid salt to provide a NaCl concentration of at least 200 grams per liter.

6. A process for substantially reducing chlorate ions and hypochlorite ions in a sodium chloride brine which comprises:

(a) acidifying said sodium chloride brine to form an acid brine having a pH of less than about 4.5, (b) reacting said acid brine with oxalic acid to reduce the concentration of hypochlorite ions and form a substantially hypochlorite-free brine, (c) dividing said substantially hypochlorite-free brine into a first portion and a second portion, (d) reacting said first portion with additional oxalic acid to reduce said chlorate ion concentration, and (e) recombining said first portion with said second portion to provide a purified brine.

7. The process of claim 6 in which the mol ratio of said oxalic acid to said hypochlorite ions in said acid brine is from about 0.03:1 to about 2.0:1.

8. The process of claim 7 in which said first portion of said substantially hypochlorite-free brine is reacted with additional oxalic acid in a mol ratio to said chlorate ions of from about 2:1 to about 4:1.

9. The process of claim 8 in which said acid brine has a pH in the range of from about 0 to about 1.

10. The process of claim 9 in which said first portion of substantially hypochlorite-free brine is at a temperature in the range of from about 75° to about 100° C.

* * * * *